US005711719A

United States Patent [19]

Fireman

[11] Patent Number: 5,711,719

[45] Date of Patent: Jan. 27, 1998

[54] GOLF CLUB

[76] Inventor: Stephen Fireman, 10 Spooner Rd., Chestnut Hill, Mass. 02167

[21] Appl. No.: 760,418

[22] Filed: Dec. 4, 1996

Related U.S. Application Data

[63] Continuation of Ser. No. 552,132, Nov. 2, 1995, abandoned.

[51] Int. Cl.[6] ..... A63B 69/36; A63B 53/02

[52] U.S. Cl. ..... 473/251; 473/305; 473/311

[58] Field of Search ..... 473/305, 306, 473/307, 308, 309, 310, 311, 312, 313, 314, 315, 324–350, 316, 251, 562

[56] References Cited

U.S. PATENT DOCUMENTS

| | | | |
|---|---|---|---|
| 1,116,417 | 11/1914 | Hackbarth | 273/80.2 |
| 1,171,806 | 2/1916 | Scott | 273/80.2 |
| 1,480,961 | 1/1924 | Smith | 473/315 |
| 1,768,378 | 6/1930 | Smith | 273/80.2 |
| 2,146,321 | 2/1939 | Wettlaufer | 273/80.8 |
| 4,253,666 | 3/1981 | Murphy | 273/80.1 |
| 4,361,325 | 11/1982 | Jansen | 473/562 |
| 4,506,888 | 3/1985 | Nardozzi | 273/80.1 |
| 4,537,403 | 8/1985 | Farina | 273/164 |
| 4,597,577 | 7/1986 | Lamanna | 273/80.1 |
| 4,762,322 | 8/1988 | Molitor | 273/77 A |
| 4,932,659 | 6/1990 | Freeberg | 273/183 |
| 5,026,062 | 6/1991 | Freeberg | 273/183 |
| 5,039,098 | 8/1991 | Pelz | 273/80.1 |
| 5,290,035 | 3/1994 | Hannon et al. | 273/167 F |
| 5,292,123 | 3/1994 | Schmidt, Jr. et al. | 273/80.2 |
| 5,312,100 | 5/1994 | Ilacqua | 473/562 |
| 5,377,980 | 1/1995 | Hannon et al. | 273/80.2 |
| 5,388,827 | 2/1995 | Reynolds | 473/306 |
| 5,435,551 | 7/1995 | Chen | 273/167 G |
| 5,577,726 | 11/1996 | Fenton | 473/340 |

FOREIGN PATENT DOCUMENTS

| | | | |
|---|---|---|---|
| 20882 | of 1909 | United Kingdom . | |
| 362486 | 11/1931 | United Kingdom | 273/80.7 |

OTHER PUBLICATIONS

Callaway Golf brochure, "1996 Callaway Golf Products", Nov. 1, 1995 2 page Advertisement for Big Bertha Utility Woods–War Bird.

Brochure, *Golf World*, Octagon Putter, Jul. 14, 1995, p. 6.

*Primary Examiner*—Sebastiano Passaniti
*Attorney, Agent, or Firm*—Fish & Richardson P.C.

[57] ABSTRACT

A golf club is provided having a shaft member and a head member separate from the shaft member. The shaft member has a flat alignment surface and the head member has a surface adapted to strike the ball in a predetermined angular relationship with the flat alignment surface. The flat ball striking surface terminates along a distal edge which is parallel to an imaginary plane disposed perpendicular to the flat alignment surface of the head member. A hole extends through the head member for receiving the distal end portion of the shaft member. The shaft and head members each have indexes keyed one with respect to the other to ensure that the flat alignment surface of the shaft and ball striking surface of the head member are properly aligned.

14 Claims, 6 Drawing Sheets

GOLF CLUB

This is a continuation of application Ser. No. 08/552,132, filed Nov. 2, 1995, now abandoned.

BACKGROUND OF THE INVENTION

This invention relates generally to golf clubs and more particularly to golf clubs configured to improve a golfer's performance.

A fundamental error made by golfers, particularly amateurs, is improperly aligning the golf ball with respect to the ball striking face of the club. Generally, if the face of the club is "open", the path of the golf ball will be to the right of the intended target and, if the face of the club is "closed", the path of the ball will be to the left of the target. This common mistake occurs whether the golfer is using a wood, an iron or a putter.

One type of putter suggested to improve a golfer's putting is described in U.S. Pat. No. 4,537,403, Ferina, issued Aug. 27, 1985 and U.S. Pat. No. 5,026,062, Freeberg, issued Jun. 25, 1991. The golf putter described therein, includes a rectangular shaft. As described in U.S. Pat. No. 4,537,403, column 2 lines 6–8, "the club is made of a metal, such as an alloy aluminum or steel, and the head is formed integral with the lower end of the shaft as shown in at 10". As described in U.S. Pat. No. 5,026,062, column 2 lines 36–37 and lines 45–49: "The head is fixedly secured to the end of a shaft 18 which is rectangular in cross section . . . The shaft 18 is preferably tapered, with its narrowest end 20 adjacent the putter head 12, terminating in a flush attachment to the ball-striking surface 16 of the head 12. In the preferred embodiment, the shaft 18 is molded and the club head is integral therewith".

SUMMARY OF THE INVENTION

In accordance with one aspect of the invention, a golf club for striking a golf ball in a desired direction, includes a shaft member and a head member having a ball striking surface and a hole sized to receive a distal end portion of the shaft member. The distal end portion of the shaft member has an index formed thereon. The hole formed in the head member has an index formed therein. The two indexes are keyed one with respect to the other to align the shaft member in a predetermined relationship with respect to the head member.

In preferred embodiments, the index formed on the shaft member is a flat surface and the index formed on the hole is a flat surface perpendicular to the ball striking surface. When the shaft member is affixed to the ball striking surface, the flat surface of the shaft member abuts the flat surface of the hole. Alternatively, the index formed on the distal end portion of the shaft member may include a slot configured to receive the index of the head member in the form of a key projecting from a wall of the hole.

The indexes ensure that the flat surface of the shaft member is disposed in a plane perpendicular to a line defining the distal edge of the head member. In the case of a wood, or iron, the distal edge may be curved and, in such case, the curved edge spans a length which defines the line that is in a direction perpendicular to the plane of the flat surface. In one embodiment, the shaft member includes a flat alignment surface. The index formed on the shaft is disposed in a predetermined relationship with the flat alignment surface of the shaft member and the index formed in the hole of the head member is in a predetermined relationship with a distal edge of head member. For example, the index formed on the shaft member may be the distal portion of the flat alignment surface of such shaft and the index formed on the hole may be a flat surface of the hole disposed perpendicular to the direction of the span of the distal or terminating edge of the ball striking surface.

In accordance with another aspect of the invention, a golf club for striking a golf ball in a desired direction, includes the following features. A shaft member has a flat alignment surface and, a head member, disposed at a distal end portion of the shaft member. The head member has a ball striking surface in a first plane with a distal edge of the ball striking surface defining a line which is parallel to an imaginary plane disposed perpendicular to the flat alignment surface of the shaft member. The first plane of the ball striking member is disposed at an acute angle (e.g., between 5° and 85°) with respect to the imaginary plane.

In a preferred embodiment, the golf club utilizes an indexing arrangement, as described above, to ensure that the flat alignment surface of the shaft member has a predetermined angular relationship with respect to the distal edge of the head member.

With such an arrangement, the golfer can use the flat alignment surface of the shaft member as an elongated planar guide to maintain the ball striking surface square against the ball when her/she strokes, chips, pitches, drives, or otherwise hits the golf ball in his/her desired direction.

In accordance with another aspect of the invention, a shaft member has a flat alignment surface and a head member, separate from the shaft member, has a ball striking surface and a hole extending there through to receive a distal end portion of the shaft member. Because the hole extends through the head member, the assembler of the golf club is assured that when the shaft is attached to the head, they have the proper alignment relationship. With conventional assembly techniques where a cavity (not extending through) is provided through the head, there may be concern as to the squareness of the cavity.

Preferred embodiments of the above aspects may include one or more of the following features. The shaft member and head member may be formed as two separate members thereby enabling each to be fabricated with a different material. Therefore, the head member may, for example in the case of a putter, be milled brass or aluminum, and the shaft member may made of another material, such as steel or graphite.

In accordance with a further feature of the invention, a method is provided for assembling a golf club. The method comprises the steps of: forming a shaft member having a flat alignment surface; forming a hole completely through a portion of a head member; and, inserting a distal end portion of the shaft member into the hole.

In preferred embodiments, the method further includes forming a flat surface within the hole of the head member; and inserting the distal portion of the flat surface of the shaft member in the hole abutting the flat surface of the hole formed in the head member. Alternatively, a key member projecting from a wall may be formed within the hole of the head member. A slot is also formed on the distal end portion of the shaft member. The slot is sized and shaped to receive, during insertion of the shaft member of the hole, the key member.

Other features and advantages of the invention will become apparent from the following detailed description and the claims.

DESCRIPTION OF THE PREFERRED EMBODIMENTS

Figure 2:
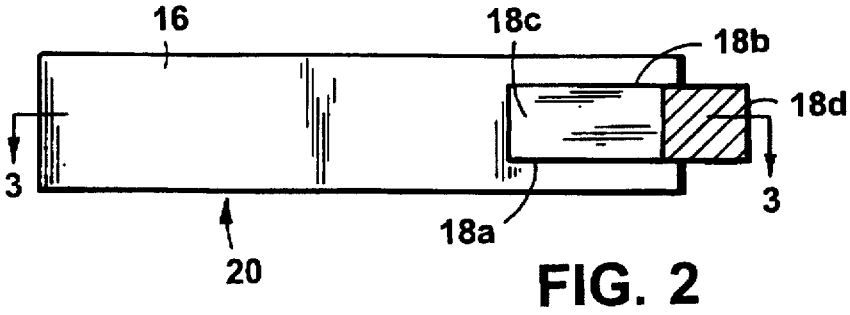
FIG. 2 is a top view of the golf club of FIG. 1.
Figure 3:
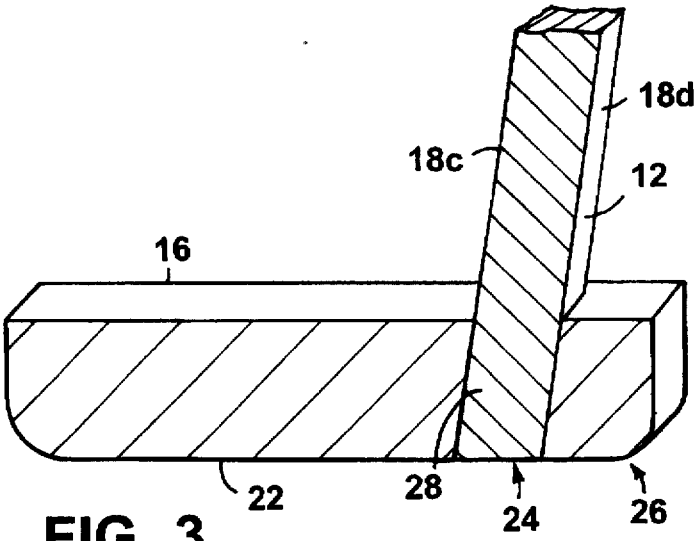
FIG. 3 is a cross-sectional view of the golf club taken along lines 3—3 of FIG. 2.
Figure 1:
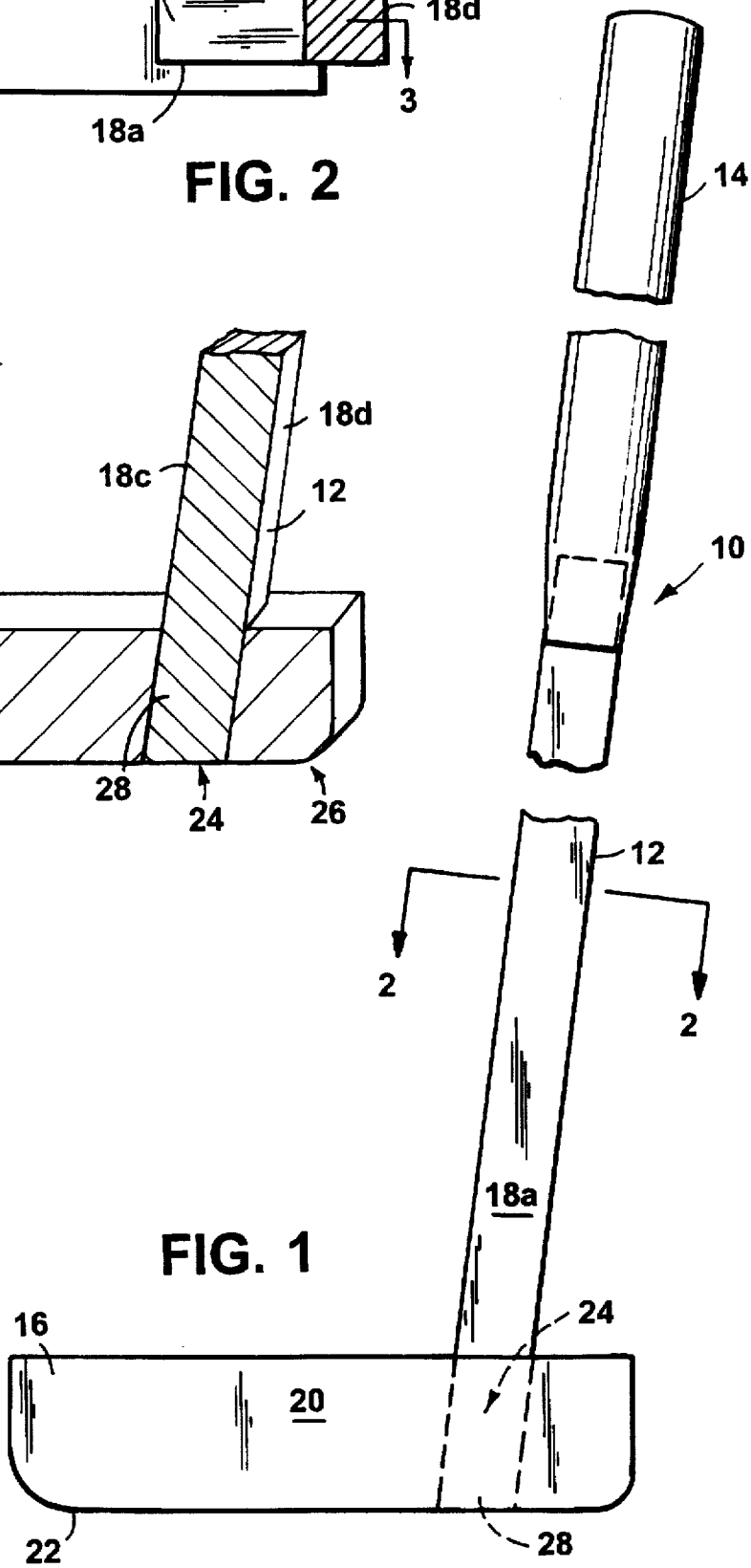
FIG. 1 is a plan view of a golf club in accordance with the invention.

Referring now to FIGS. 1, 2 and 3, a golf club 10, here a putter, is shown having an elongated shaft member 12, a handle 14, and a head member 16. The shaft member 12 has four flat surfaces; surfaces 18*a*, 18*b* being disposed parallel to each other and flat surfaces 18*c*, 18*d* being disposed parallel to each other. Surfaces 18*a*, 18*b* are perpendicular to surfaces 18*c*, 18*d*. Thus, here, the cross section of shaft member 12 is either square, or rectangular. Here, the cross section of shaft member 12 is square. More particularly, here shaft member 12 is ⅜" square aluminum. Other materials, such as steel or graphite, may be used. The head member 16 has a flat surface 20 adapted to strike a golf ball, not shown. The flat surface 20 of the head member 16 terminates along a bottom terminating edge 22 which is closest to the putting green and golf ball when the golfer strokes the ball towards the cup.

Figure 4:
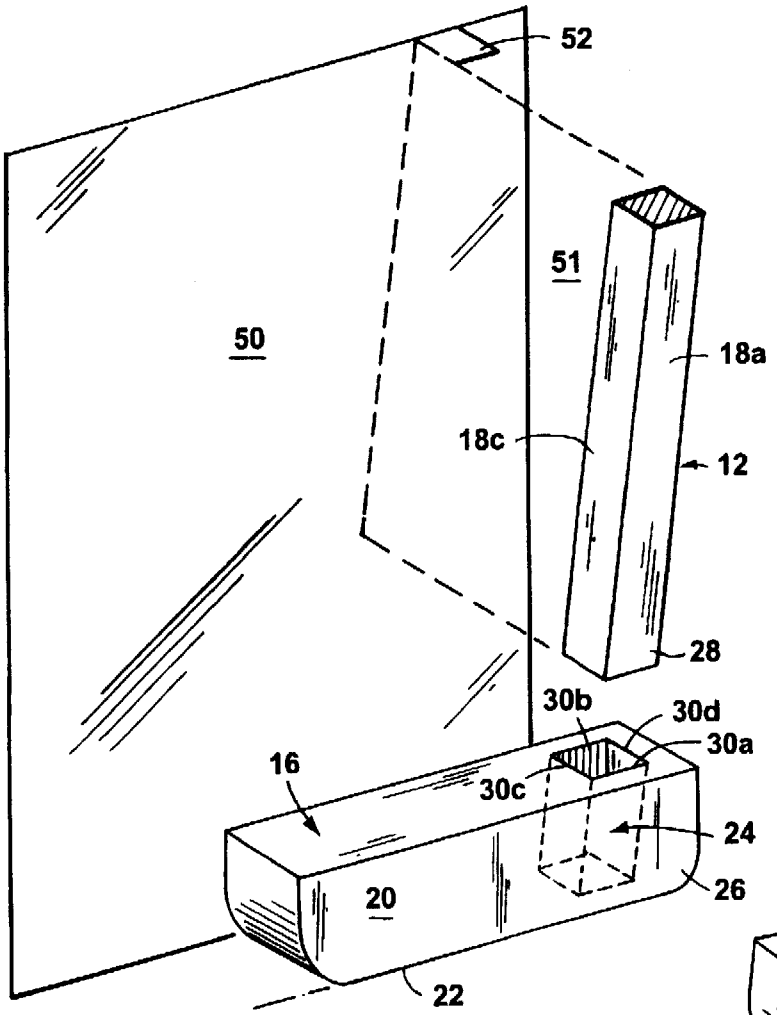
FIG. 4 is a partially exploded perspective view of the golf club of FIG. 1.

Referring also to FIG. 4, the head member 16 has a hole 24, here of square cross section, formed completely through the heel, or rear, portion 26 of the head member 16. Thus, the hole 24 is formed with four flat sides 30*a*, 30*b*, 30*c*, 30*d*, as shown. It is noted that sides 30*a*, 30*b* are parallel to edge 22 of flat 20, while sides 30*b*, 30*c* are perpendicular with the edge 22. The hole 24 is sized to receive the distal portion 28 of the shaft member 12. With such arrangement, when the shaft member 12 is attached to the head member 16, flat surface 18*c* is in a plane 51 perpendicular to an imaginary plane 50 (note angle 52). Planes 50 and 51 are shown in dashed lines. Concomitantly, imaginary plane 50 is parallel to the bottom terminating edge 22. That is, flat surface 18*c* provides an alignment surface which the golfer can use as an elongated planar guide to maintain the ball striking surface square against the ball when the golfer strokes the ball towards the cup. The golfer need only address the ball so that the plane of flat surface 18*c* is pointed toward or extends to the intended target. In this way, the golfer is assured that the ball striking surface of the clubhead is not in an open or closed position.

It should be noted that the use of separate members for the shaft member 12 and the head member 16 enables fabricating the head member 16 from a material (e.g., in the cases of a putter, milled brass or aluminum), different than a material (e.g., steel or graphite) used to fabricate the shaft member 12.

It should also be noted that the distal end portion 28 of the shaft member 12 has an index formed thereon, here any one of the flat surfaces 18*a*, 18*b*, 18*c*, 18*d*. Likewise, the hole 24 formed in the head member 16 has a corresponding index formed thereon, here flat surfaces 30*a*, 30*b*, 30*c*, 30*d*, respectively. The index on the head member 16 is keyed to the index formed on the shaft member 12 and is disposed in a predetermined relationship with the aforementioned flat surface 20 and terminating edge 22. These indicia (i.e. flat surface 18*c* and flat surface 30*c*, for example) are keyed one with respect to the other to ensure that, when the two members 12, 16 are affixed to each other, (e.g., using a suitable epoxy), the flat alignment surface 18*c* of shaft member 12 is in the desired predetermined relationship to the terminating edge 22 of the head member 16. In the case of the putter, as shown in FIG. 4, flat alignment surface 18*c* is perpendicular to the terminating edge 22 of the head member 16. Also, the head member 16 index, here flat surface 30*c*, is in a predetermined relationship to the terminating edge 22 (i.e., here surface 30*c* is perpendicular to terminating edge 22). Therefore, when the distal portion 28 of shaft member 12 is affixed to head member 16, the flat surface 18*c* of the shaft member 12 will abut the flat surface 30*c* of the hole 24 and the flat surface 18*c* of the shaft member 12 will be disposed in a predetermined relationship with the terminating edge 22 of the head member 16.

In the case of other golf clubs, for example wedges or irons, the ball striking surface is disposed at an acute angle ($\alpha$) with respect to the longitudinal axis of the elongated shaft member 12. Here again, however, the flat alignment surface of the shaft member is positioned with respect to the head of the club to be perpendicular to the terminating edge of the ball striking surface of the head (i.e., the leading edge closest to the ball when the golfer addresses the golf ball).

Figure 5:
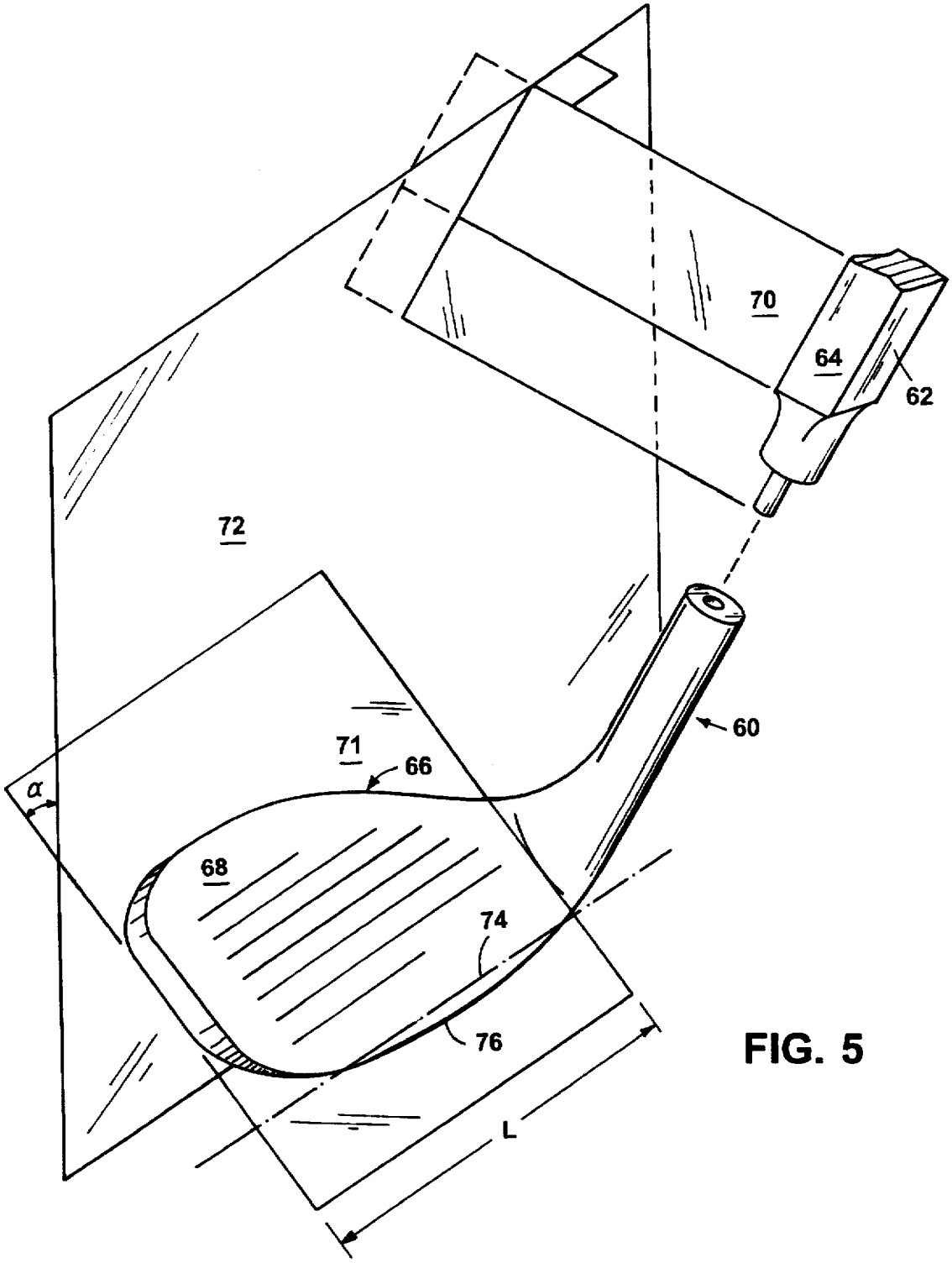
FIG. 5 is a partially exploded perspective view of a golf club having a lofted clubface.
Figure 6:
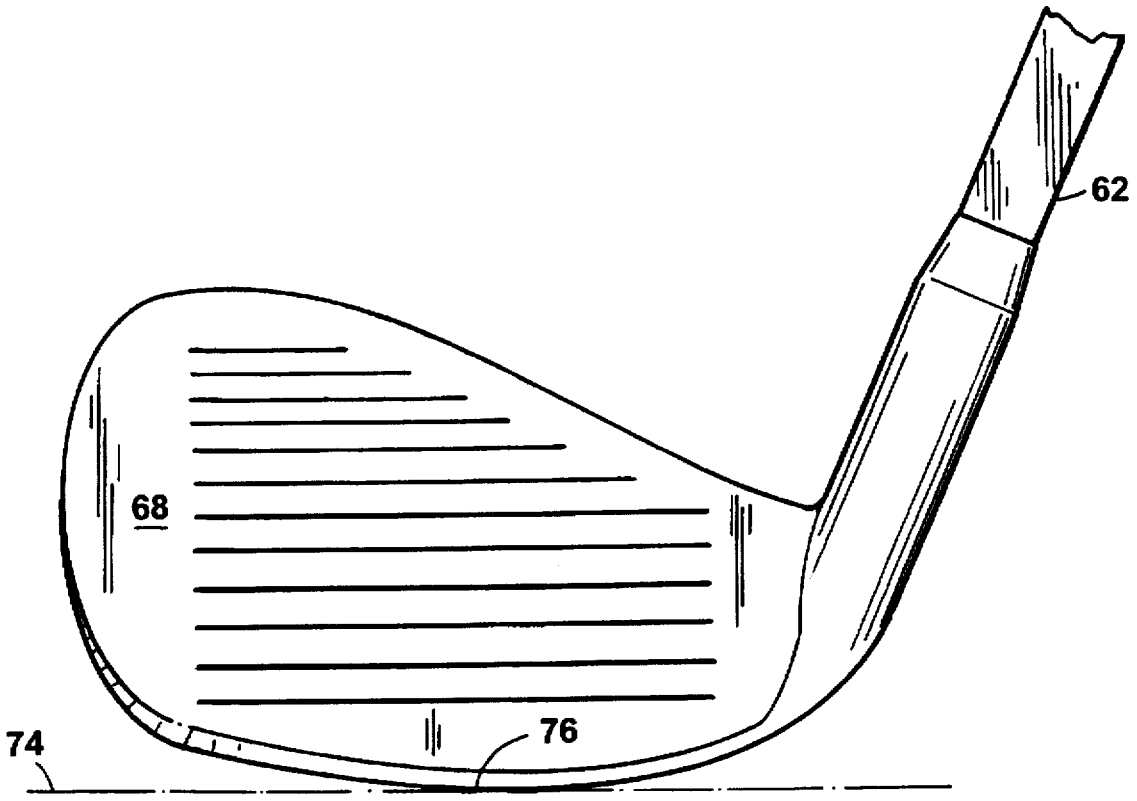
FIG. 6 is a front view of the golf club of FIG. 5.
Figure 7:
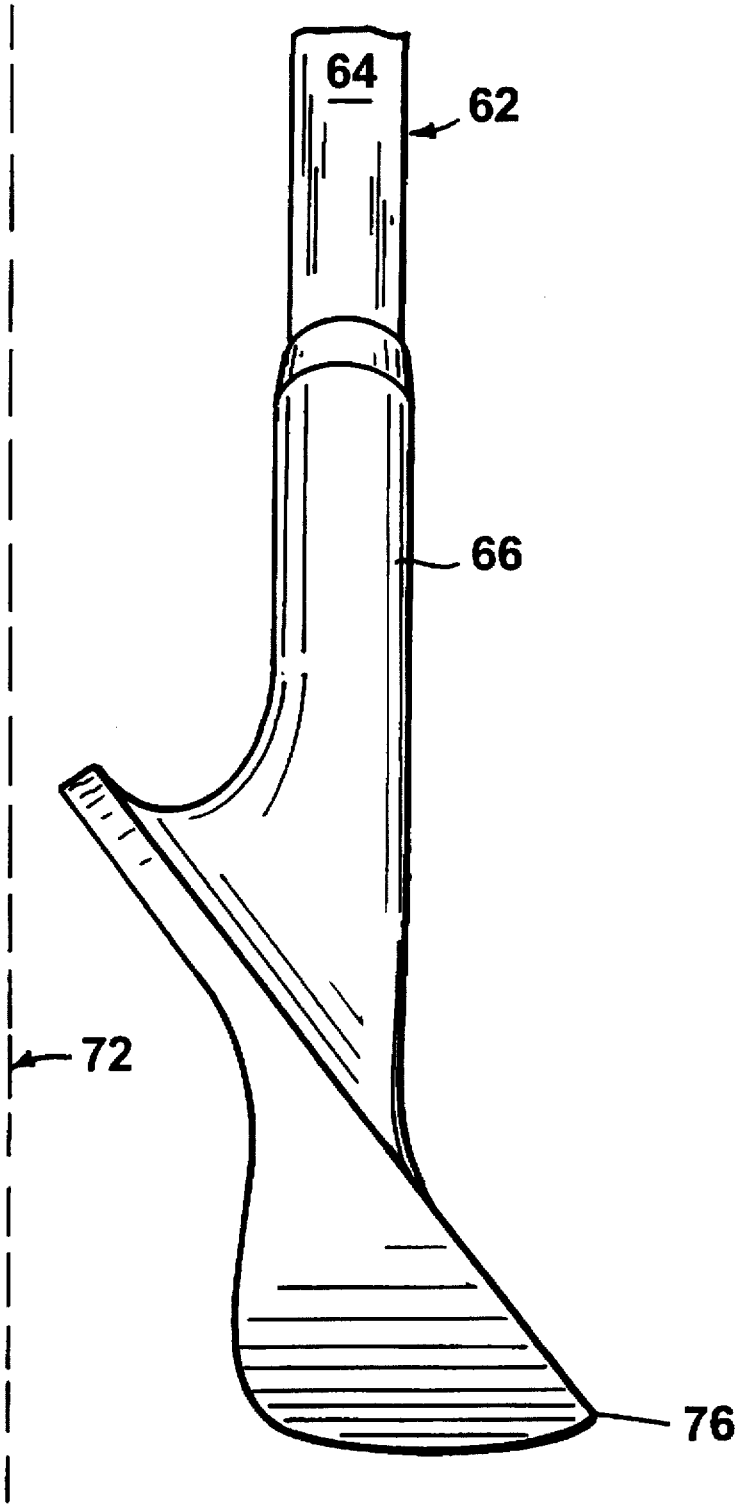
FIG. 7 is a side view of the golf club of FIG. 5.

For example, referring to FIGS. 5, 6 and 7, an iron 60 includes a rectangular shaft 62 having a flat alignment surface 64. Shaft 64 is attached to a clubhead 66 having a pitched or lofted ball striking surface 68 (i.e., the clubface). As was the case with the putter 10 of FIGS. 1–4, clubhead 66 is attached to the shaft so that the flat alignment surface 64 is in a plane 70 perpendicular to an imaginary plane 72 (shown in dashed lines). This imaginary plane is parallel to a line 74 (shown dashed) which extends through a length (L) spanning the curved bottom and terminating edge 76 of the clubhead. As mentioned above, this relationship is maintained regardless of the loft of the club. As shown in FIG. 5, ball striking surface 68 lies in a plane 71 at an angle ($\alpha$) with respect to imaginary plane 72. With clubhead 66 attached to shaft 62 in this manner, the golfer has an alignment surface which can be used to maintain the ball striking surface square (i.e., not open or closed) against the ball at the moment of impact. Thus, when the golfer grips the club and addresses the ball the flat alignment surface serves as a planar alignment guide pointing to the target.

It is appreciated that in some circumstances, the shaft may be affixed to the club so that line 74 is slightly offset from parallel by a predetermined angle (e.g., 2°–5°). For example, the ball striking surface of the clubhead may be made intentionally open a small amount (e.g., 2 degrees) to account for the ball compressing and being carried on the clubface during the short period of time after impact.

Figure 8:
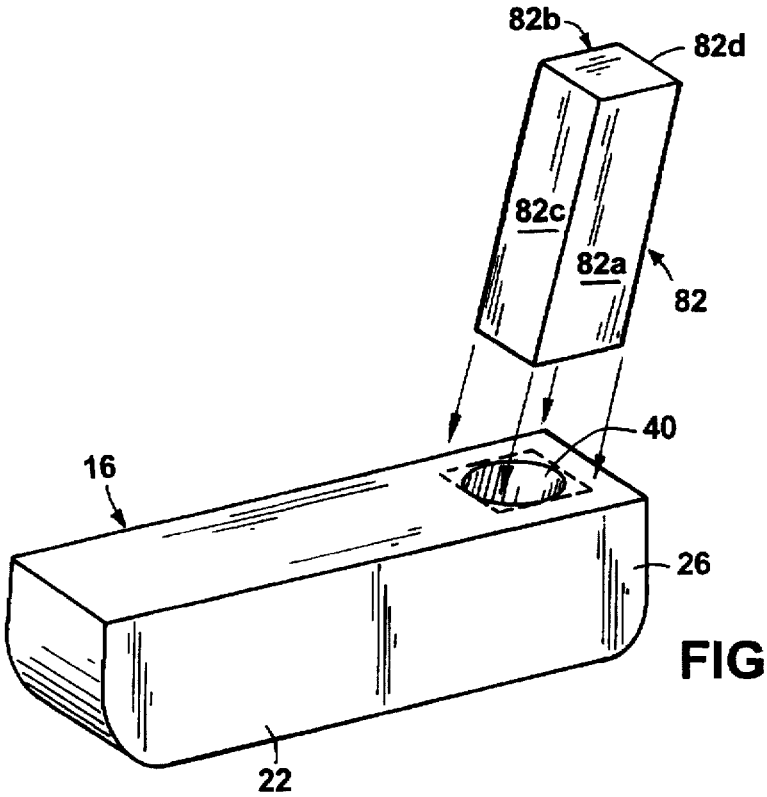
FIGS. 8–10 illustrate a method of providing a hole in the head member of the golf club of FIG. 1.
Figure 9:
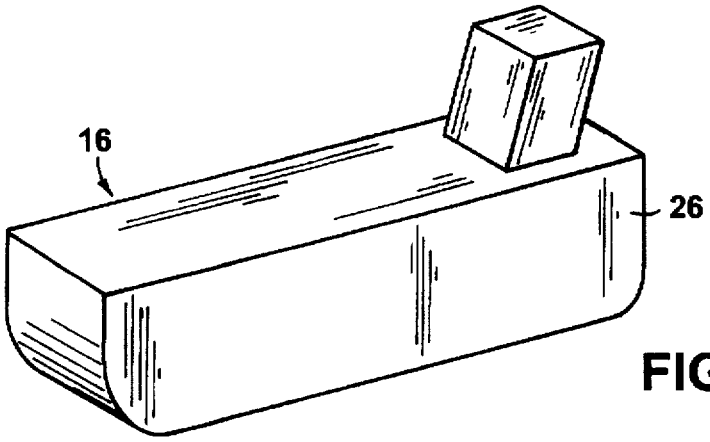
Figure 10:
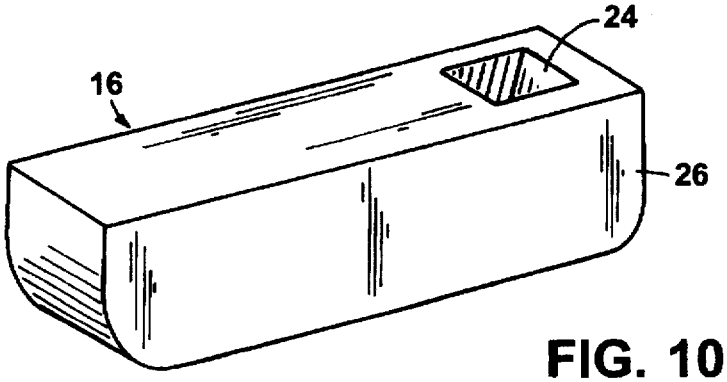

Referring to FIGS. 8–10 and the embodiment of putter 10, hole 24 in head member 16 is formed by first drilling a hole 40 completely through the heel portion 26 of the head member. The resulting hole 40 will therefore have a round cross section. A punch 82, having a square cross section is then placed in contact with the mouth of the formed hole 40. More particularly, the four edges 82*a*, 82*b*, 82*c*, 82*d* of the punch are placed in contact with four corresponding peripheral region of the circular cross section hole. The sides of the punch are then aligned with the edge 22, here with the flat ball striking surface 20 of the head member 16. After such alignment, the punch is forced completely through the previously formed hole 40 (FIG. 9). The punch thereby forces the surface portions 82*a*, 82*b*, 82*c*, 82*d* in contact with the sides of the punch 82 through the hole 40. As shown in FIG. 10, the result is hole 24 having a square cross section with flat surfaces 30*a*, 30*b*, 30*c*, 30*d* as shown in FIG. 4.

Other embodiments are within the spirit and scope of the appended claims. For example, other keying arrangements may be used to properly align and join the distal end portion 28 of the shaft member 12 with head member 16.

Figure 11:
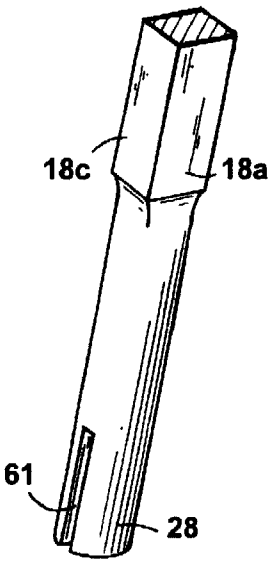
FIG. 11 is a plan view of an alternate embodiment of a shaft member of the golf club of FIG. 1.
Figure 11:
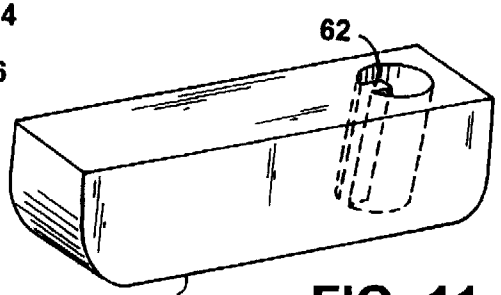

Referring to FIG. 11, for example, the distal end portion 28 of the shaft member 12 may be made circular in cross section. In such case, a slot 61 may be formed in the distal end portion 28 of the shaft member 12. The slot 61 is in a predetermined orientation to the flat alignment surface 18*a* of the shaft member 12. Here, for example, slot 61 is perpendicular to the flat alignment surface 18*c* of the shaft member 12. In this case, a portion of the surface of the hole formed in the head member 16 has a projection 62 is in predetermined relationship with the terminating edge 22. Here, for example, the projection 62 is formed parallel to the terminating edge 22. Thus, the distal end portion 28 of the shaft member 12 will only be insertable into hole when projection 62 passes into slot 61 to ensure that, when the shaft member 12 and the head member 16 are attached to each other, the flat alignment surface 18*c* of the shaft member 12 will be perpendicular to the terminating edge 22 of the head member 16.

What is claimed is:

1. A golf club for striking a golf ball in a desired direction, comprising:

a straight shaft member of square or rectangular cross section having first and second pairs of opposing side surfaces extending from a distal end of the shaft member and along a substantial portion of the shaft member, the second pair of opposing side surfaces perpendicular to the first pair of side surfaces; and a head member having a ball striking surface and a heel portion, said head member having a square or rectangular hole sized to receive the distal end of the straight shaft member, the distal end of the straight shaft providing an index, the square or rectangular hole formed in the head member providing an index formed therein, and keyed to receive the index provided by the distal end of the shaft member to align the second pair of opposing surfaces to be parallel with the ball striking surface of the head member.

2. The golf club recited in claim 1 wherein the index provided by the square or rectangular hole comprises a flat surface perpendicular to the ball striking surface.

3. The golf club recited in claim 1 wherein the index provided by the distal end of the straight shaft member includes a slot configured to receive the index provided by the head member in the form of a key projecting from a wall of the square or rectangular hole.

4. The golf club recited in claim 1 wherein the index provided by the square or rectangular hole of the head member is in a predetermined relationship with a distal edge of head member.

5. The golf club recited in claim 4 wherein the distal edge of the ball striking surface defines a line which is parallel to an imaginary plane disposed perpendicular to the first pair of opposing surfaces of the straight shaft member.

6. The golf club recited in claim 1 wherein the ball striking surface defines a first plane disposed at a predetermined angle with respect to the first pair of opposing surfaces of the straight shaft member.

7. The golf club recited in claim 6 wherein the first plane is substantially perpendicular to the first pair of opposing surfaces of the straight shaft.

8. The golf club recited in claim 1 wherein the shaft member and the head member are each fabricated with a different material.

9. A golf club for striking a golf ball in a desired direction, comprising:

a straight shaft member having an elongated flat alignment surface extending from a distal end and along a substantial portion of the shaft member; and, a head member, disposed at the distal end of the shaft member, the head member having a heel portion, the head member having a ball striking surface in a first plane with a distal edge of the ball striking surface defining a line which is parallel to an imaginary plane disposed perpendicular to the flat alignment surface of the shaft member, the first plane disposed at an acute angle with respect to the imaginary plane.

10. The golf club recited in claim 9 wherein the acute angle is in a range between 5 and 85 degrees.

11. The golf club recited in claim 9 wherein the head member has a hole sized to receive a distal end of the shaft member, the distal end of the shaft having an index formed thereon disposed in a predetermined relationship with the flat alignment surface of the shaft member, the hole formed in the head member having an index formed therein in a predetermined relationship with the distal edge of head member, and keyed to receive the index formed in the shaft member.

12. The golf club recited in claim 9 wherein the shaft member and the head member are each fabricated with a different material.

13. The golf club recited in claim 11 wherein the index formed on the hole is a flat surface perpendicular to the ball striking surface and when the shaft member is affixed to ball striking surface, the flat surface of the shaft member abuts the flat surface of the hole.

14. The golf club recited in claim 9 wherein a portion of the elongated flat alignment surface of the shaft member is external to the head member when the shaft member is received within the head member.

* * * * *